US006032870A

United States Patent [19]

Simoens

[11] Patent Number: 6,032,870

[45] Date of Patent: Mar. 7, 2000

[54] PROCESS FOR FITTING A GAS-INJECTING NOZZLE IN A WALL AND MEANS FOR CARRYING OUT THIS PROCESS

[76] Inventor: Herve Simoens, 40 Avenue Foch, 59700 - Marcq en Baroeul, France

[21] Appl. No.: 08/930,582

[22] PCT Filed: Apr. 17, 1996

[86] PCT No.: PCT/FR96/00581

§ 371 Date: Feb. 2, 1998

§ 102(e) Date: Feb. 2, 1998

[87] PCT Pub. No.: WO96/33380

PCT Pub. Date: Oct. 24, 1996

[30] Foreign Application Priority Data

Apr. 20, 1995 [FR] France ..... 95 04948

[51] Int. Cl.[7] ..... B05B 17/04

[52] U.S. Cl. ..... 239/1; 239/104; 239/456; 239/601; 134/167 C; 134/167 R; 134/168 C; 134/168 R

[58] Field of Search ..... 239/73, 600, 104, 239/456, 601; 134/167 C, 167 R, 168 C, 168 R

[56] References Cited

U.S. PATENT DOCUMENTS

| | | | |
|---|---|---|---|
| 2,465,236 | 3/1949 | Lade et al. | 239/456 |
| 4,196,050 | 4/1980 | Takahashi et al. | 134/167 R |
| 4,373,909 | 2/1983 | Petit et al. . | |
| 4,479,612 | 10/1984 | Umbache et al. | 239/456 |
| 4,611,613 | 9/1986 | Kaplan | 134/167 R |
| 4,646,768 | 3/1987 | Tanaka et al. | 134/167 R |

FOREIGN PATENT DOCUMENTS

| | | |
|---|---|---|
| 3907887 | 10/1989 | Germany . |
| 9201690 | 7/1992 | Germany . |
| 2140142 | 11/1984 | United Kingdom . |

*Primary Examiner*—Kevin Shaver
*Assistant Examiner*—David Deal
*Attorney, Agent, or Firm*—Kerkam, Stowell, Kondracki & Clarke; William L. Feeney

[57] ABSTRACT

The invention concerns a process for fitting a gas-injecting nozzle in the wall of an installation. The process is characterized in that an external supporting surface (11) whose shape matches the so-called internal supporting surface (12) of the passage (6) provided in the bedding brick is associated with the nozzle (2); the nozzle is placed opposite the passage (6) in the bedding brick: the nozzle (2) is moved in axial translation so as to adjust the position thereof along the longitudinal axis of the passage and move the front face of the nozzle into a desired initial position; the nozzle is locked in this desired initial position; and, at least periodically, the nozzle is inserted further forwards into the passage in the bedding brick in order to compensate the wear in the front face of the nozzle. The invention can be used to prevent clogging, such as in a cement producing plant.

8 Claims, 3 Drawing Sheets

PROCESS FOR FITTING A GAS-INJECTING NOZZLE IN A WALL AND MEANS FOR CARRYING OUT THIS PROCESS

BACKGROUND OF THE INVENTION

The invention relates to a process for mounting a gas-injecting nozzle in a wall of an installation.

It also relates to means for implementing the process, and to this end, it relates to a device for mounting a gas-injecting nozzle in a wall of an installation.

It also relates to the nozzles designed to be mounted by means of mounting devices of this type, downstream from a gas-injecting device, for example, for the forced discharge of gas in order to prevent the clogging of an installation such as a cement producing plant.

In these installations, the material in effect has a tendency to agglutinate at various points along its path, and consequently these masses must periodically be removed.

For purposes of this removal, it has long been known to provide openings in the wall of these installations, such as holes which are normally closed by plugs and which, when these plugs are removed, allow a worker to insert through this hole a cleaning rod with which he scrapes off and/or breaks up the accumulations.

This work is difficult and can even be dangerous, therefore increasingly frequent use is being made of devices for permanently mounting a nozzle for injecting forced air, for example issued from an air gun mounted outside the installation.

Originally, the injecting nozzle was simply embedded into a bedding brick placed among the bricks constituting the wall.

The channel of this nozzle opens at its front end into the interior of the installation in an area where the material agglutinates and connects outside the installation, directly or via an intermediate conduit, to means for producing a forced discharge of gas.

When the nozzle is embedded into the bedding brick, the nozzle and the bedding brick have a front face which must be positioned so as to be flush with the inner surface of the wall, since any unevenness would tend to promote wear on the front face of the nozzle or the bedding brick, as well as the formation of masses of material.

This wear is caused by the temperature and the force of the materials flowing through the installation.

After it is worn, the brick is broken in orde to dislodge the nozzle and replace it with another nozzle which will be embedded in the same way.

To avoid having to re-break the brick, it is known to embed the nozzle in a plug removably mounted in a complementary housing of the bedding brick embedded into the wall.

According to this solution, in order to obtain the relatively precise positioning of the front face of the nozzle, the housing of the bedding brick and the plug that houses the nozzle have complementary conical shapes, so that the nozzle is positioned both radially and longitudinally at the same time.

When the front face is judged to be worn, that is, to be too deeply eroded, the plug and thus the nozzle are removed and replaced by a new assembly.

This operation, which is not in itself very costly in terms of the materials exchanged is nevertheless disadvantageous due to the time required for the intervention and the frequency of it.

BRIEF SUMMARY OF THE INVENTION

One object of the invention is to obtain a mounting process of the type mentioned above which makes it possible to eliminate the above-mentioned drawbacks.

To this end, the subject of the invention is a process of this type for mounting an injecting nozzle of the above-mentioned type, specifically characterized in that:

an external supporting surface whose shape matches the so-called internal supporting surface of the passage disposed in the bedding brick is associated with the nozzle, and these complementary internal and external supporting surfaces have cross-sections which, except for the mounting clearance, are identical and extend axially along respective lengths such that they allow the nozzle to slide with its external supporting surface inside the internal supporting surface of the passage along a distance such that the nozzle can not only be moved into position inside the passage by axial translation until its front face is flush with the inner surface of the wall, but can also be displaced further, and during mounting, the nozzle is placed opposite the passage provided in the bedding brick, the nozzle is moved in axial translation so as to adjust its position along the longitudinal axis of the passage and to bring its front face into a desired initial position, the nozzle is locked into this desired initial position and, at least periodically, in order to compensate for the wear on the front face of this nozzle, it is inserted further forward into the passage of the bedding brick until the front face of this nozzle is again in a position similar to the initial position.

The invention also relates to means for implementing the process.

The nozzles designed to be mounted using these means are also subjects of the invention.

BRIEF DESCRIPTION OF THE SEVERAL VIEW OF THE DRAWINGS

The invention will be better understood with the aid of the following description given as a non-limiting example in reference to the appended drawing, which schematically represents:

FIGS. 1 through 3: a view in axial section of a nozzle running through a wall, FIG. 4: a wear indicator in axial section.

DETAILED DESCRIPTION OF THE INVENTION

Figure 1:
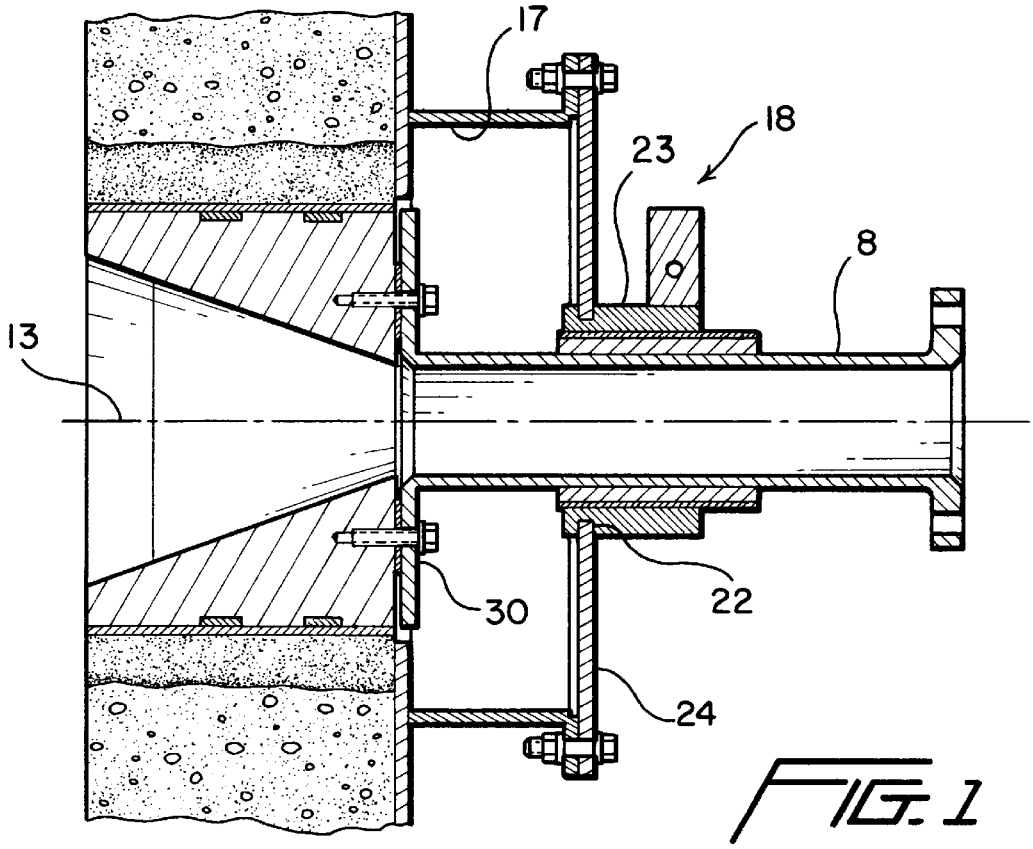
Figure 4:
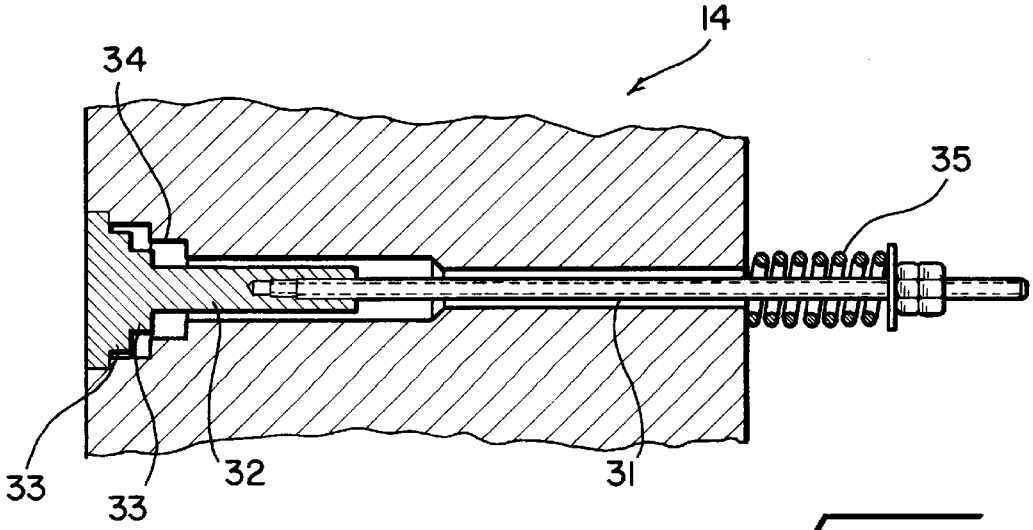
Figure 2:
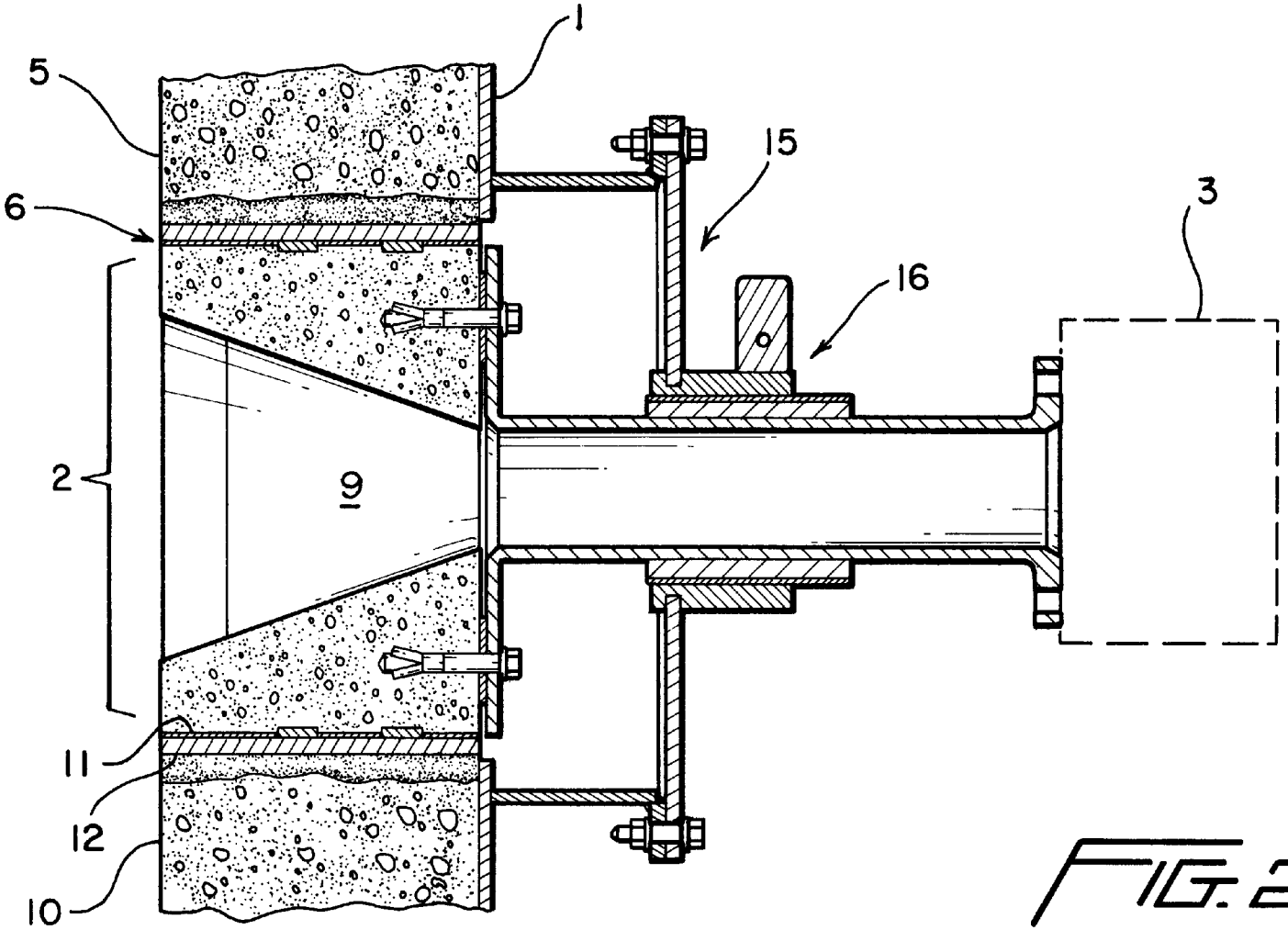
Figure 3:
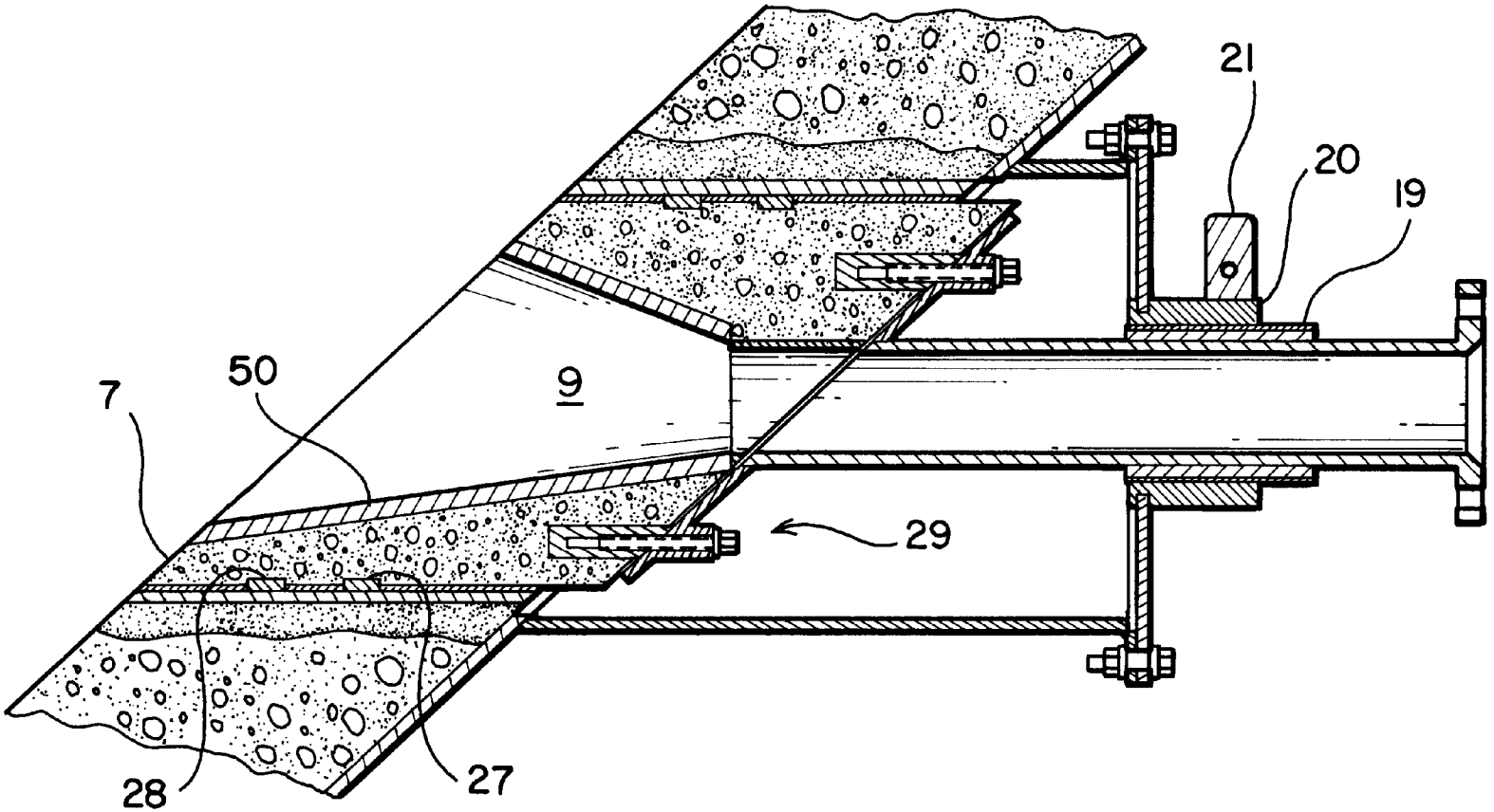

Referring to the drawing, it may be seen that in order to periodically eliminate the accumulations of materials that can occur in a predetermined volume such as that defined by the wall 1 of a furnace, a provision is made for mounting forced gas-injecting nozzles 2 through this wall at various places.

In standard fashion, these forced gas-injecting nozzles 2 are connected outside the volume to means 3 for generating a forced gas discharge and the injecting nozzle passes through the wall 1 so as to open into the interior of the volume.

Also, in a known way, in order to mount the injecting nozzle into the wall, a so-called bedding brick 5 is inserted which fits into the wall and delimits a passage 6 that receives the nozzle 2, whose channel 9:

opens at the front face 7 of the nozzle into the volume where the material agglutinates and, connects from the side opposite the one that opens into the furnace, directly or via a connecting conduit 8, to means 3 for producing a forced gas discharge.

Generally, the channel 9 of the nozzle has a cross-section which, at least in one plane, widens in the direction of the volume to be treated.

In particular, in order to limit the wear on the front face 7 of the injecting nozzle 2, during the mounting this front face 7 is positioned flush with the internal surface 10 of the wall in which the nozzle is housed.

According to an essential characteristic of the process according to the invention:

an external supporting surface 11 whose shape matches the so-called internal supporting surface 12 of the passage 6 disposed in the bedding brick is associated with the nozzle 2, and these complementary internal and external supporting surfaces have cross-sections which, except for the mounting clearance, are identical and extend axially along respective lengths such that they allow the nozzle 2 to slide with its external supporting surface 11 inside the internal supporting surface 12 of the passage 6 along a distance such that the nozzle can not only be moved into position inside the passage by axial translation until its front face is flush with the inner surface of the wall, but can also be displaced further, and during mounting, the nozzle is placed opposite the passage 6 provided in the bedding brick, the nozzle 2 is moved in axial translation so as to adjust its position along the longitudinal axis 13 of the passage and to bring its front face into a desired initial position, the nozzle is locked into this desired initial position and, at least periodically, in order to compensate for the wear on the front face of this nozzle, it is inserted further forward into the passage of the bedding brick until the front face of this nozzle is again in a position similar to the initial position.

A means 14 for at least indirectly monitoring the wear on the front face of the nozzle is installed at least in proximity to the nozzle, or is integrated with the nozzle.

According to one characteristic of the invention, the means for implementing the process comprise:

an external supporting surface 11 whose shape matches the so-called internal supporting surface 12 of the passage 6 disposed in the bedding brick is associated with the nozzle, and these complementary internal 11 and external 12 supporting surfaces have cross-sections which, except for the mounting clearance, are identical and extend axially along respective lengths such that they allow the nozzle 2 to slide with its external supporting surface 11 inside the internal supporting surface 12 of the passage 6 along a distance such that the nozzle can not only be moved into position by axial translation until its front face is flush with the inner surface of the wall, but can also be displaced further, and this nozzle is connected to the wall by means 15, 16 for controlling its axial translation, which make it possible:

both to adjust the position of the nozzle along the longitudinal axis of the passage and, in so doing, to be able to insert it further forward from its initial position so as to progressively compensate the wear on its front face, and to lock the nozzle into the desired position.

These dispositions are very advantageous since, instead of systematically replacing the partially worn nozzle periodically as it becomes worn, it is inserted deeper into the passage in such a way that the front face is repositioned each time so as to be substantially flush with the inner surface of the wall, thus greatly reducing the frequency of the replacement of the nozzle.

In order to constitute these control means 16, the wall comprises, integral with its external surface, which is generally covered with sheet metal, at least one support 17 for a device 18 for adjusting the axial positioning of the nozzle.

In a preferred embodiment, the device 18 for adjusting the axial position of the nozzle cooperates with the connecting conduit 8 between the nozzle 2 and the means 3 for producing the forced gas discharge.

Preferably, in order to constitute the device for adjusting the axial positioning between the connecting conduit and the support, at least one simple bolt 19 and nut 20 system is interposed and, for example, the conduit is provided at least indirectly with a threading 19 that cooperates with a threaded ring 20 which, relative to the support 17, rotates freely but is immobilized in translation.

Obviously, the threaded ring 20 comprises handling means 21 which facilitate the control of its rotation.

The threading with which the threaded ring 20 cooperates can be disposed on the external surface of a sleeve mounted on the connecting conduit 8.

In order to be immobilized in translation relative to the support, the ring can have a peripheral groove 22 in which can be engaged the edge 23 of the opening of a plate 24 divided into two parts and also attached to the support 17.

Subject to its having the above-mentioned characteristics, the nozzle can be designed to be made from any material that is compatible with its function.

It can, for example, be constituted of non-oxidizing refractory ferrous material or refractory concrete.

In the case of a nozzle made of non-metallic refractory material, its channel can be lined with a metal sheet 50 of nonoxidizing, especially refractory, material.

It is also possible to provide a cylindrical sleeve of nonoxidizing material around the nozzle.

In order to improve the sliding of the external supporting surface inside the internal supporting surface of the passage, the latter can also be lined with a layer of suitable material such as a fabric or a braid of ceramic fiber or a metal bushing attached and held in place, for example by support lugs in the wall.

In order to ensure good tightness between the internal and external supporting surfaces, it is advantageous to provide at least one sealing strip 27 which can be housed in a groove 28 in either the internal or the external supporting surface.

In one embodiment, the conduit that extends the channel comprised inside the nozzle is removably connected to the nozzle, and the corresponding end of this conduit has a means 29 for attaching to the rear surface or the nozzle, such as a connecting flange.

If necessary, sealing means 30 will be provided between this flange and the rear surface of the nozzle.

In order to determine the moment and the amplitude of the forward motion to be communicated to the nozzle once the wear sustained by its front face exceeds a certain value, the mounting device comprises a wear indicator 14, mounted in the wall in immediate proximity to the nozzle so that the wear indicated substantially coincides with that of the front face of the nozzle.

As indicated above, this wear indicator can be housed either in the bedding brick, or directly in the material delimiting the channel of the nozzle.

The wear indicator can be constituted by a rod 31 which carries at its end disposed on the side of the volume to be treated, a block 32 of material identical to that which constitutes the nozzle.

The sliding to be imparted to the nozzle in order to return its front face to its predetermined initial position is determined by removing this rod and examining the length of the block of material.

It is also possible for the wear to be indicated automatically once it reaches a certain threshold.

For example, the block of material could be constituted by a piece that is stepped, for example by stacking several disks 33 that decrease in diameter from the front end, this block of material being housed in a cavity that is itself formed by an equal number of bores 34 of decreasing cross-section, each bore having a cross-section greater than or equal to that of the disk which corresponds to it, but less than that of the preceding disk, that is, the one located nearer to the interior of the volume than it is, the depth of the second-to-last bores being greater than the thickness of the corresponding disks and, the stepped piece being subjected, by an elastic means 35, to a traction directed toward the exterior of the volume, so that when the largest disk is worn due to the traction exerted on the rod, the latter is displaced until the next disk comes to rest against the bottom of the next step of the bore, which displacement of the rod causes its end to project further outside the wall, thus allowing visual monitoring of the wear and of the necessity to reposition the nozzle.

I claim:

1. A process for mounting a gas injection nozzle through a wall of a furnace for the forced discharge of gas to prevent the clogging of the furnace, the steps comprising:

inserting the nozzle with a front surface into a passage through the wall, the wall being a molded brick wall and the insertion being such that the passage receiving the nozzle delimits the nozzle, the nozzle having a channel whose cross-section widens in a direction towards front surface, which front surface faces an interior of the furnace;

connecting an end of the nozzle opposite the front end to means for producing a forced gas discharge; and wherein the inserted nozzle has an external supporting surface with a shape complementary to an internal supporting surface of the passage, and wherein these complementary internal and external supporting surfaces which are identical except for the mounting clearance and which extend axially along respective lengths such that they allow a sliding of the nozzle with its external supporting surface inside the internal supporting surface of the passage over a distance such that the insertion step is until the front surface of the nozzle is flush with an inner surface of the wall in an initial position;

locking the nozzle into the initial position; and, at least periodically, in order to compensate for the wear on the front surface of the nozzle, inserting the nozzle further toward the interior of the furnace until the front surface of the nozzle returns to being flush with the inner surface of the wall.

2. The process for mounting the gas injection nozzle according to claim 1 further comprising the step of installing, proximate to the nozzle, a means for at least indirectly monitoring the wear on the front surface of the nozzle.

3. The process for mounting the gas injection nozzle according to claim 2 further comprising the step of: installing actuating means with at least one support supporting a device for adjusting the axial position of the nozzle.

4. The process for mounting the gas injection nozzle according to claim 3 wherein the device for adjusting the axial positioning of the nozzle cooperates with a connecting conduit interposed between the nozzle and the means for producing the forced gas discharge.

5. The process for mounting the gas injection nozzle according to claim 4 wherein the device is at least a bolt and nut system and further comprising the step of adjusting the bolt and nut system to adjust the axial position of the nozzle.

6. The process for mounting the gas injection nozzle according to claim 5 wherein the process uses a conduit that is at least indirectly provided with a threading which, relative the support, rotates freely but is immobilized in translation.

7. The process for mounting the gas injection nozzle according to claim 2 wherein the installed means for at least indirectly monitoring the wear is a wear indicator mounted through the wall, in immediate proximity to the nozzle, so that the wear indicated substantially coincides with that of the front surface of the nozzle.

8. The process for mounting the gas injection nozzle according to claim 7 wherein the installed wear indicator is constituted by a rod (31) which carries at its end disposed on the side of the volume to be treated, a block (32) of material identical to that which constitutes the nozzle, and the block of material is constituted by a piece which is stepped by stacking several disks (33) decreasing in diameter from the front end, this block of material being housed in a cavity that is itself formed by as many bores (34) of decreasing cross-section, each bore having a cross-section greater than or equal to that of the disk which corresponds to it, but less than that of the preceding disk, that is, the one located nearer than it to the interior of the volume, the depth of the second-to-last bores being greater than the thickness of the corresponding disks, and the stepped piece being subjected, by an elastic means, to a traction directed toward the exterior of the volume, so that when the largest disk is worn due to the traction exerted on the rod, the latter is displaced until the next disk comes to rest against the bottom of the next step of the bore, which displacement of the rod causes its end to project further outside the wall, thus allowing a visual monitoring of the wear.

* * * * *